US005859631A

United States Patent [19]

Bergman et al.

[11] Patent Number: 5,859,631

[45] Date of Patent: Jan. 12, 1999

[54] APPARATUS FRONT PANEL ALLOWING INDICIA ON AN INDICIA-BEARING ELEMENT TO BE READ THERETHROUGH

[75] Inventors: Jonas Bergman, Stockholm; Pär Emtell, Bromma, both of Sweden

[73] Assignee: Siemens Elema AB, Solna, Sweden

[21] Appl. No.: 769,866

[22] Filed: Dec. 19, 1996

[30] Foreign Application Priority Data

Dec. 21, 1995 [SE] Sweden ..... 9504581

[51] Int. Cl.[6] ..... G09G 5/00

[52] U.S. Cl. ..... 345/173; 345/184; 345/156; 345/961

[58] Field of Search ..... 345/173, 184, 345/156, 961; 368/69

[56] References Cited

U.S. PATENT DOCUMENTS

| | | | |
|---|---|---|---|
| 4,566,001 | 1/1986 | Moore et al. . | |
| 4,653,086 | 3/1987 | Laube . | |
| 4,692,809 | 9/1987 | Beining et al. . | |
| 5,254,979 | 10/1993 | Trevett et al. . | |
| 5,418,760 | 5/1995 | Kawashima et al. | 345/173 X |
| 5,572,239 | 11/1996 | Jaeger | 345/184 X |

FOREIGN PATENT DOCUMENTS

| | | |
|---|---|---|
| 0 182 715 | 5/1986 | European Pat. Off. . |
| 0 303 752 A1 | 2/1989 | European Pat. Off. . |
| 0 306 305 A2 | 3/1989 | European Pat. Off. . |
| 0 395 293 A1 | 10/1990 | European Pat. Off. . |
| 0 485 776 A3 | 5/1992 | European Pat. Off. . |
| OS 32 30 919 | 3/1983 | Germany . |
| OS 34 09 532 | 9/1985 | Germany . |
| WO 88/07235 | 9/1988 | WIPO . |

OTHER PUBLICATIONS

Robert Tobias, "The LR33020 GraphX Processor: A single Chip X–Terminal Controller," LSI Logic Corporation, IEEE, Feb. 24, 1992, pp. 358 to 363.

O. Awsienko et al., "Boundary Aligner," IBM Technical Disclosure Bulletin, Dec. 1984, vol. 27, No. 7B, pp. 4247–4248.

*Primary Examiner*—Steven J. Saras
*Assistant Examiner*—Seth D. Vail
*Attorney, Agent, or Firm*—Hill & Simpson

[57] ABSTRACT

An apparatus front panel has a mechanical user interface in the form of a mechanically controllable regulation and setting elements on the face of the front panel. The front panel is manufactured at least in part from a transparent material in which electrical conductors and components are arranged in order to electrically connect the controllable regulation and setting elements from the face of the front panel with the electrical equipment present in the apparatus via a front panel connection. The front panel is constructed so that it can be attached at least in part to a substantially flat indicia-bearing element such as in front of a screen, in front of a display, or over a printed base or the like.

23 Claims, 2 Drawing Sheets

APPARATUS FRONT PANEL ALLOWING INDICIA ON AN INDICIA-BEARING ELEMENT TO BE READ THERETHROUGH

BACKGROUND OF THE INVENTION

1. Field of the Invention

The present invention relates to an apparatus front panel with a mechanical user interface in the form of mechanically controllable regulation and setting elements on the face of the front panel.

2. Description of the Prior Art

It is often necessary to alter the appearance of the apparatus front panel, e.g. the language of a text on the front panel, indicates associated with scales or dials, or to carry out other changes, e.g. as a result of a changed function in the apparatus. Heretofore, this problem has been solved by exchanging the front panel and the associated electronics, displays and control means. This has the disadvantage that a number of different front panels has to be kept in reserve for a single apparatus.

Touch screens, having several different transparent layers on which conductive patterns are printed, are known. The layers are touch-sensitive in such a way that the impedance in the conductive pattern is altered upon pressure or upon touching the layer on the screen, and this change in impedance is used to call up various functions in an associated computer. German OS 34 09 532, U.S. Pat. Nos. 4,653,086 and 4,566,001 describe such devices, in which resistive changes upon touching the touch-sensitive layers are used, and German OS 32 30 919 describes a technique in which capacitive changes arising upon touching are used to control a display device. These known techniques are suited in particular for applications in which the user has to choose between a number of information images, as in menu selection, process control in the field of industry, different instruments, etc.

SUMMARY OF THE INVENTION

An object of the present invention is to provide an apparatus front panel having a mechanical user interface that is simple to alter and to bring up to date.

The above object is achieved in accordance with the principles of the present invention in an apparatus front panel having a mechanical user interface in the form of mechanically controllable regulation and setting elements on the face of the front panel, wherein the front panel is composed at least in part of transparent material in which electrical conductors and components are arranged so as to electrically connect the regulation and setting elements with electrical equipment contained in the apparatus of which the front panel is a part. The front panel is attachable at least partially in front of a substantially flat, indicia-bearing element such as a screen, a display, or a base provided with printing.

The appearance of the inventive front panel can thus be easily altered by altering the appearance of the screen lying behind it or altering the appearance of the display, i.e. in this case the alteration of the appearance of the front panel ensues via software or by exchanging the base provided with the printing. A further advantage of the front panel according to the invention is that it is simple to manufacture; a known technique essentially can be used. The electrical conductors are preferably manufactured with a known hybrid printing technique, and are thin enough so that they do not disturb the transparency. Moreover, the front panel is easily fastened to a screen or on a display, and is thereby also easy to exchange.

According to an embodiment of the inventive front panel, a part of the front panel is constructed so as to be attachable over a screen or over a display, while a further part of the front panel is constructed so as to be attachable over a base provided with printing. By this arrangement, a number of different combinations are possible on the inventive front panel. Parts of the inventive front panel can also be opaque.

In a further embodiment of the inventive apparatus front panel, it has three assembled layers, with the aforementioned electrical conductors, as well as the components, arranged in the rearmost layer, while the middle layer serves as an insulating and spacing layer and the front layer serves as control for the regulation and setting elements. The insulating capacity of the middle layer must be sufficient so that components such as potentiometers can operate with analog signals. In order to avoid the formation of bubbles between the layers, they are preferably assembled by means of vacuum gluing. As an alternative, the front and middle layer can be manufactured in one piece.

In a further embodiment of the inventive front panel, a conductive layer such as a metal or carbon layer is arranged between the front and the middle layer in order to shield against electromagnetic interference. As an alternative, the front layer can be conductive.

The rearmost layer of the inventive front panel can be made very thin, while the other layers must be thick enough so that the regulation and setting elements such as push keys and rotating knobs have are sufficiently guided in the region of their through-holes through these layers. The layers should not be made thicker than necessary, however, since the thickness can influence the transparency. According to the invention, the total thickness of the front panel will preferably be less than 1 cm.

In a further embodiment of the inventive front panel, recesses are bored in the front and middle layer for the regulation and control elements. These layers must have a certain thickness so that the regulation and setting elements, as mentioned above, are sufficiently guided in these recesses. In addition, according to a further embodiment of the inventive front panel, the through-holes for the regulation and setting elements are sealed against the face of the panel or against the wall of the bored recesses, e.g. with an O-ring.

In another embodiment of the inventive front panel, the screen or the base provided with printing is constructed as a thin display that lies fixedly against the back side of the front panel. Inexpensive displays suited for this purpose are commercially available products. In this way, a complete front panel unit is provided.

DESCRIPTION OF THE PREFERRED EMBODIMENTS

Figure 1:
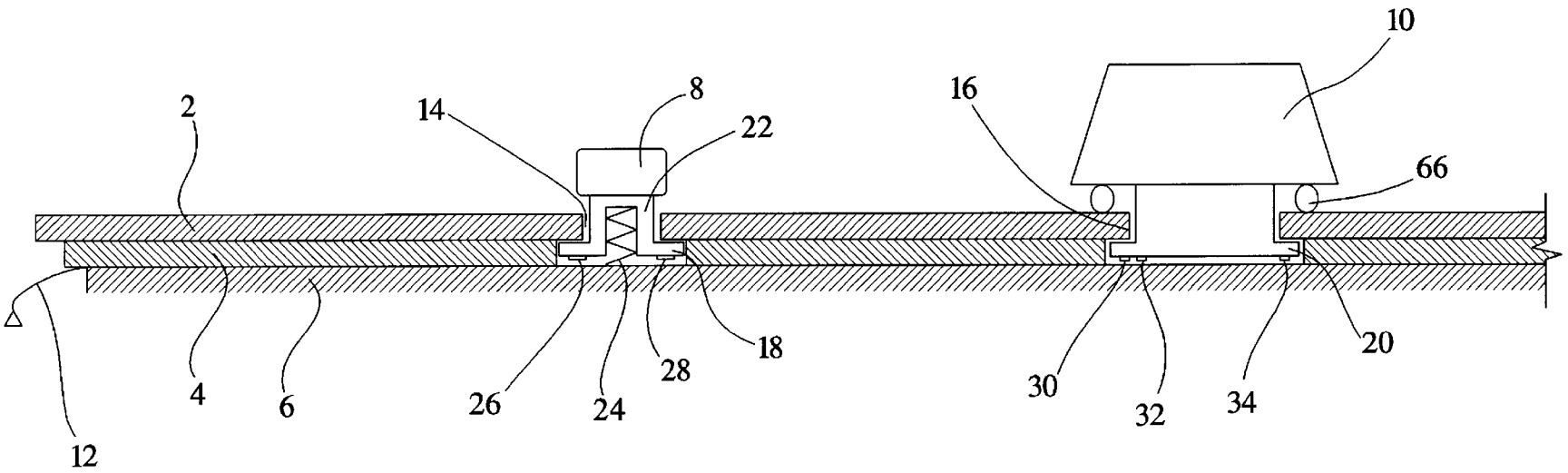
FIG. 1 shows an exemplary embodiment of the inventive front panel, in cross-section.

The embodiment of the inventive front panel shown in FIG. 1 includes three layers 2, 4 and 6, assembled to one another each made of a transparent material such as a glass-like plastic, e.g., Plexiglas®. The layers 2, 4 and 6 are assembled by means of vacuum gluing in order to avoid the formation of bubbles between the layers. The layers 2 and 4 can alternatively be manufactured in one piece.

Thin conductor patterns are printed on the rear layer 6, in order to connect various controllable mechanical regulation and setting elements on the face of the front panel with a front panel connection 12 in the form of contacts or flat (ribbon) cables. These conductor patterns, which are thin enough so that they do not disturb the transparency, are produced using a silk screening technique. The printed conductor patterns can also be produced from carbon paths.

Due to the fact that the front panel has only one front panel connection 12, the front panel can be switched on and off when it is necessary to exchange it.

Figure 2:
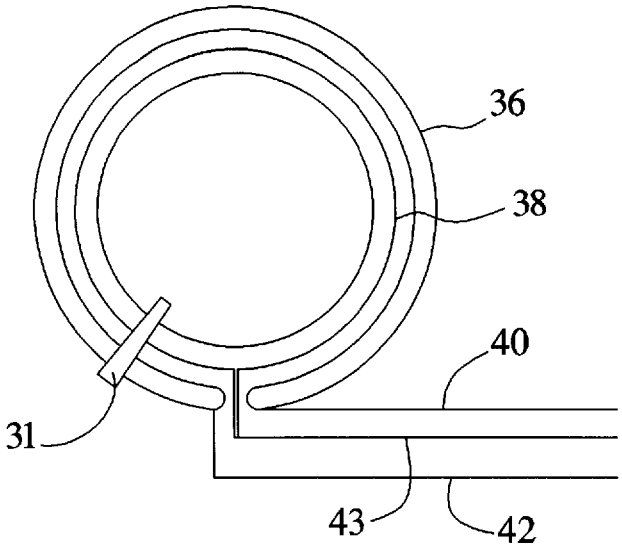
FIG. 2 shows an example of a pattern for a potentiometer on the inventive front panel.

The layer 4 is an insulating and spacing layer, and the front layer 2 serves as a guide for the mechanical regulation and setting elements 8 and 10. The layer 4 must have a sufficient insulating capacity so that components such as potentiometers can operate using analog signals (FIG. 2). The rear layer 6 can be made very thin, while the front layer 2 must be thick enough so that the mechanical regulation and setting elements, such as the push key 8 and the rotating knob 10, are sufficiently guided in their respective recesses 14 and 16 of the layers 2 and 4. The total thickness of the layers 2, 4 and 6 should not be greater than necessary, since a thickness which is too large can have a negative effect on the transparency of the front panel. The total thickness of the inventive front panel should be less than 1 cm, which ensures a good transparency.

In order to shield against electromagnetic interference, a shielding layer is preferably arranged between the layers 2 and 4. The shielding layer is a conductive layer such as a layer of metal or carbon. A metallized polyester foil can alternatively be used. The foil is transparent, since the metal layers can be made very thin, ca. 300 nm. A thin, woven metal cloth can also be used. Such a cloth can be made from a stainless steel thread or from a black-oxidized copper thread with a thread diameter of 0.05 mm and a mesh size of 100 openings per inch, making the cloth sufficiently transparent.

As another alternative, the layer 2 can be made conductive, e.g. by means of metallization, in order to serve as a shield against electromagnetic interference.

The recesses 14 and 16 for the mechanical regulation and setting elements, such as the push key 8 and the rotating knob 10, are bored in the layers 2 and 4. The recesses 2 and 4 are expanded at the layer 4, so that the push key 8 and the rotating knob 10 are held in their respective recesses 14 and 16 by respective protruding flange-like parts 18 and 20 that lie on the layer 6 at the end sides of the push key 8 and the rotating knob 10.

A spring 24 is arranged inside the through-piece 22 of the push key 8, which key extends into the recess 14 and is hollow. The pressure spring 24 lies with one end against the layer 6 and with its other end against the outwardly-directed end (seen from the front panel out) of the through-piece 22, so that the spring 24 presses the push key 8 outwardly, seen from the inside of the front panel and the layer 6.

On the front side of the flange-like part 18, which is rotatable against the layer 6 and the conductor pattern thereof, two contacts 26 and 28 are arranged. These contacts 26 and 28 can be connected with parts of the conductor pattern, provided for this purpose, on the layer 6, by pressing the push button 8 in the inward direction in the front panel by overcoming the pressing force of the spring 24. If the two contacts 26 and 28 are electrically connected with one another, corresponding contacted parts of the conductor pattern can accordingly be connected with one another by pressing the key 8.

The push key 8 can possibly be provided with only one contact, e.g. 26, while the contact 28 is a "dummy contact" serving as a support, so that the push key is not skewed (canted) in its recess 14 upon being pressed as contact 26 comes into connection with the layer 6. The rotating knob 10 can be the rotating knob of a potentiometer, a switch, a pulse generator or the like. In this case as well, contacts 30 and 32 are arranged on the surface of the flange-like part 20 rotated against the layer 6 and the conductor pattern thereof. On the same surface, substantially diametrically opposite the contacts 30 and 32, a support 34 is arranged, so that the rotating knob 10 always assumes a correct position in the recess 16.

FIG. 2 shows a potentiometer pattern on the conductor pattern of the layer 6, which potentiometer pattern being provided to lie underneath the rotating knob 10. The potentiometer pattern has a resistance path 36, whose ends are connected to respective conductors 40 and 42, as well as a closed circuit path 38 connected to a conductor 43.

In this case, a contact plate 31 is arranged in place of the contacts 30 and 32, the plate 31 lying against the paths 36 and 38. A part of the overall resistance path between the conductors 40 and 43 or between the conductors 42 and 43, is consequently short-circuited, and this short-circuited part can thus be varied by rotating the knob 10.

Consequently, by means of the rotational position of the rotating knob 10, complementarily varying resistances are respectively is obtained between the conductors 40 and 43 or between the conductors 42 and 43. In practice, it is often the case that two of the conductors, e.g. the conductors 42 and 43, are coupled together, and the measurement ensues between the coupled-together conductors 42 and 43 and the conductor 40.

Figure 3:
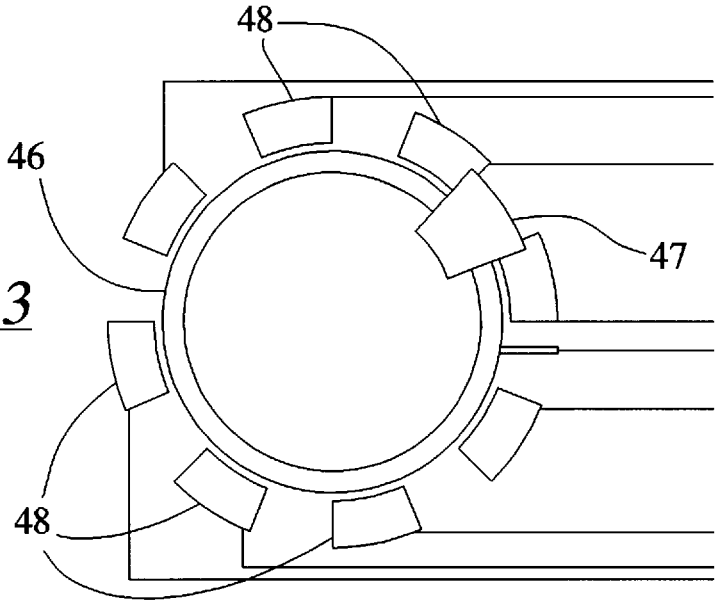
FIG. 3 shows a first example of a pattern for a switch or a pulse generator on the inventive front panel.

FIG. 3 shows the pattern of a switch or a pulse generator on the conductor pattern of the layer 6, which is also provided to lie underneath a rotating knob such as e.g. the rotating knob 10. The switch or the pulse generator has a circular conductor 46. Outside this conductor 46, metal tongues 48, directed radially inward, are arranged at regular intervals. A contact plate, controllable with the rotating knob 10 shown in FIG. 1, or a contact tongue 47 lies permanently against the conductor 46, which is often connected to ground. The contact plate 47 is broad enough so that in certain positions it produces a connection with two metal tongues 48 positioned nearby, while in the positions in between it stands in connection with only one of the metal tongues 48. Upon rotation of the rotating knob 10, one or two of the metal tongues 48 is/are successively connected with the conductor 46 connected to ground. By measurement of the resistance between the metal tongues 48 and the conductor 46 connected to ground, it is thus possible to determine the position of the contact plate 47, as well as the direction of rotation thereof.

Figure 4:
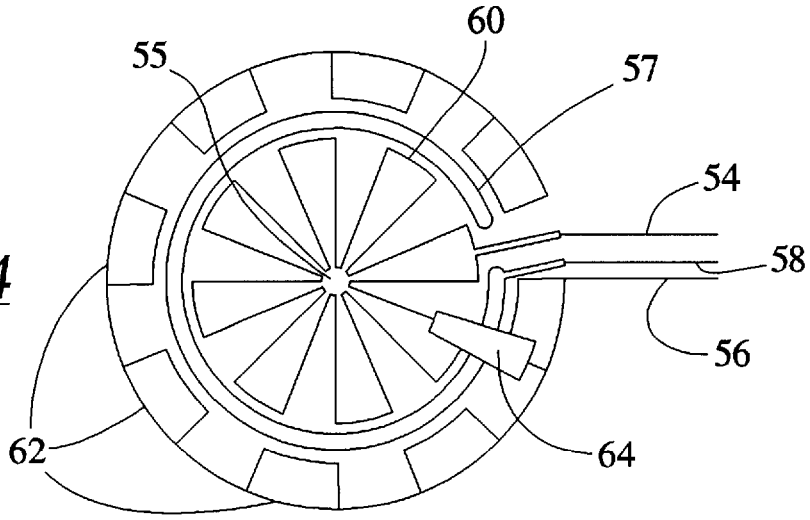
FIG. 4 shows a second example of a pattern for a switch or a pulse generator on the inventive front panel.

FIG. 4 shows the pattern of an additional embodiment of a switch or a pulse generator, which also makes it possible to identify in which direction the associated rotating knob, and thereby also the contact tongue 64, is rotated. This pattern has three conductors 54, 56 and 58. The conductor 54 is connected with a circular core 55, around whose circumference are arranged outwardly directed metal tongues 60 at regular intervals. The conductor 56 is connected in a corresponding way with a circular part provided with inwardly-directed conductive tongues, also arranged at regular intervals. A reference conductor 57, connected to ground, is arranged between these conductors. This reference conductor is connected to the conductor 58. In addition, a contact tongue 64 is provided that can be rotated over the metal tongue 60, over the circular conductor 57, and over the tongues 62 by means of a rotating knob arranged on the face of the front panel. The contact tongue 64 is in constant connection with the reference conductor 57 and, as seen inwardly from the conductor 57, extends outward and inward in such a way that it produces a contact with the tongues 60 and 62 upon being rotated past them. In contrast, the contact tongue 64 does not reach the circular parts of the inner and outer conductors. Upon rotation of the contact tongue 64, the reference conduction 57 becomes successively connected to one of the outer tongues 62, an outer tongue 62 and an inner tongue 60, only an inner tongue 60, an inner tongue 60 and an outer tongue 62, only an outer tongue 62, etc. This causes the resistance between the conductors 54 and 58, or between 56 and 58, to be varied as two phase-shifted impulse trains, from which the direction of rotation of the contact tongue 64 can be determined. The exact appearance and the opposed positions of the impulse trains are determined by the construction of the tongues 60 and 62, as well as the opposed positions thereof.

It is important that sealing is ensured in relation to the inner front panel in the region of the through-holes for the regulation and setting elements 8 and 10. A sealing O-ring 66 is thus arranged around the rotating knob 10 in FIG. 1. Similarly, suitable sealing means (not shown) must be arranged on the push key 8 for sealing against the face of the front panel or against the wall of the recess 14.

The inventive front panel is easy to attach to the screen or to the display, permitting the appearance of the front panel to be easily altered by altering the appearance of the screen or of the display. The inventive front panel, however, is preferably attached over a base provided with printing, e.g. a printed piece of cardboard, so that the appearance of the front panel can be altered by exchanging the base. The inventive front panel can also be constructed so that it is, e.g., placed partly on the screen or on the display and partly over a printed base, and a part or parts of the front panel can be opaque. This opaque part can possibly be provided with e.g. a text on the face of the front panel, either by printing the text directly on the front panel in this part or by gluing a printed piece of paper onto the front panel part.

In place of a screen or a printed base, a thin display adapted to give the appearance of a front panel can be attached to the rearmost layer. In this way, a complete front panel unit is given.

Although modifications and changes may be suggested by those skilled in the art, it is the intention of the inventors to embody within the patent warranted hereon all changes and modifications as reasonably and properly come within the scope of their contribution to the art.

We claim as our invention:

1. In an apparatus containing a plurality of controllable electrical components, the improvement of a front panel for said apparatus comprising:

said front panel having a front exterior face and a rear exterior face and being at least partially composed of transparent material;

a plurality of mechanically operable regulation and setting elements projecting from said front exterior face of said front panel;

electrical conductors disposed in said front panel electrically connecting said regulation and setting elements to said electrical components in said apparatus; and a substantially flat indicia-bearing element, said rear exterior surface of said front panel extending over at least a portion of said indicia-bearing element with said indicia being visible through said transparent material.

2. The improvement of claim 1 wherein said substantially flat, indicia-bearing element comprises a screen.

3. The improvement of claim 1 wherein said substantially flat, indicia-bearing element comprises a display.

4. The improvement of claim 1 wherein said substantially flat, indicia-bearing element comprises a base having printing thereon.

5. The improvement of claim 1 wherein a portion of said front panel is attachable over a screen and a further portion of said front panel is attachable over a base provided with printing.

6. The improvement of claim 1 wherein a portion of said front panel is attachable over a display and a further portion of said front panel is attachable over a base provided with printing.

7. The improvement of claim 1 wherein said transparent material comprises a glass-like plastic.

8. The improvement of claim 1 wherein said front panel comprises three assembled layers including a rear layer containing said electrical conductors, an intermediate layer comprised at least in part of insulating material, and a front layer comprising a mechanical guide for receiving said regulation and control elements.

9. The improvement of claim 8 wherein said three layers are assembled by vacuum gluing.

10. The improvement of claim 8 wherein said front layer and said intermediate layer comprise a single piece.

11. The improvement of claim 8 further comprising a conductive layer disposed between said front layer and said intermediate layer.

12. The improvement of claim 11 wherein said conductive layer comprises a metal layer.

13. The improvement of claim 11 wherein said conductive layer comprises a carbon layer.

14. The improvement of claim 8 wherein said front panel consists at least in part of conductive material.

15. The improvement of claim 1 wherein said front panel has a thickness which is less than 1 cm.

16. The improvement of claim 1 wherein said regulation and setting elements each comprise a printed conductor pattern on a face of said front panel and manually actuatable elements for altering electrical connections within said printed conductor pattern.

17. The improvement of claim 1 wherein said regulation and setting elements each comprise a carbon paths on a face of said front panel and manually actuatable elements for altering electrical connections within said carbon paths.

18. The improvement of claim 1 wherein said electrical conductors comprise hybrid printed electrical conductors.

19. The improvement of claim 1 wherein said front panel comprises a front layer, an intermediate layer and a rear layer, said rear layer containing said electrical conductors, and wherein said front layer and said intermediate layer comprise a plurality of recesses respectively receiving said regulation and setting elements.

20. The improvement of claim 19 further comprising means for sealing each regulation and setting element against an exterior face of said front panel.

21. The improvement of claim 19 further comprising means for sealing each regulation and setting element against a wall of the bore in which that regulation and sealing element is received.

22. The improvement of claim 1 wherein at least one of said regulation and setting elements comprises an outer series of electrical contact plates disposed on said front panel, an inner series of electrical contact plates disposed on said front panel, an electrical reference conductor disposed between said inner and outer series of contact plates, a contact tongue always in contact with said reference conductor, and manually actuatable means for rotating said contact tongue for causing said contact tongue to selectively connect plates in said inner series to each other or plates in said outer series to each other or plates in said inner series to plates in said outer series.

23. The improvement of claim 1 wherein said substantially flat, indicia-bearing element comprises a thin display fixed against a rear side of said front panel.

* * * * *